US006554533B2

(12) United States Patent
Godbersen

(10) Patent No.: US 6,554,533 B2
(45) Date of Patent: Apr. 29, 2003

(54) HYDRAULIC BOAT HOIST

(76) Inventor: Byron L. Godbersen, Lake LaJune Estates, Ida Grove, IA (US) 51445

( * ) Notice: Subject to any disclaimer, the term of this patent is extended or adjusted under 35 U.S.C. 154(b) by 8 days.

(21) Appl. No.: 09/833,911

(22) Filed: Apr. 12, 2001

(65) Prior Publication Data

US 2002/0150427 A1 Oct. 17, 2002

(51) Int. Cl.[7] ..... B63C 3/06
(52) U.S. Cl. ..... 405/3; 114/44
(58) Field of Search ..... 405/3, 1, 7; 114/44

(56) References Cited

U.S. PATENT DOCUMENTS

| | | | | | |
|---|---|---|---|---|---|
| 2,505,832 | A | | 5/1950 | Lange | |
| 3,169,644 | A | | 2/1965 | Godbersen | |
| 3,177,668 | A | | 4/1965 | Schneider et al. | |
| 3,276,211 | A | | 10/1966 | Drake | |
| 3,857,248 | A | | 12/1974 | Rutter | |
| 4,195,948 | A | | 4/1980 | Vancil | |
| 4,401,335 | A | * | 8/1983 | Godbersen | 187/213 |
| RE32,118 | E | | 4/1986 | Godbersen | |
| 4,641,596 | A | * | 2/1987 | Reprogle et al. | 405/3 |
| 4,686,920 | A | | 8/1987 | Thomas | |
| 4,763,592 | A | * | 8/1988 | Russ | 405/3 |
| 4,773,346 | A | | 9/1988 | Blanding et al. | |
| 4,808,028 | A | * | 2/1989 | White | 405/3 |
| 5,090,841 | A | * | 2/1992 | Penick et al. | 405/3 |
| 5,522,671 | A | * | 6/1996 | Keesling | 405/3 |
| 5,655,850 | A | * | 8/1997 | Holmgren | 405/3 |
| 5,888,019 | A | * | 3/1999 | Quastad | 405/3 |
| 5,890,835 | A | * | 4/1999 | Basta et al. | 405/3 |
| 5,908,264 | A | * | 6/1999 | Hey | 405/3 |
| 5,915,877 | A | * | 6/1999 | Sargent et al. | 405/3 |

OTHER PUBLICATIONS

1–page—publication entitled "Worth ABOVE GROUND HOIST"—undated, but publication depicted was available in 1994.

6–pages—drawings of THE SIDEWINDER by Keibler Tech Inc., dated Sep. 10, 1990.

* cited by examiner

*Primary Examiner*—Frederick L. Lagman
(74) *Attorney, Agent, or Firm*—Henderson & Sturm LLP

(57) ABSTRACT

A boat hoist including a four-post rectangular frame structure having a pair of rails connected between pairs of posts in a parallel manner, a hydraulic piston and cylinder unit mounted within one rail and operationally connected to a level lift pulley and cable suspension system interconnected between the frame and a vertically movable platform mounted on the frame, the piston and cylinder unit provided with either a switch or a valve to prevent accidental lowering of the platform.

3 Claims, 5 Drawing Sheets

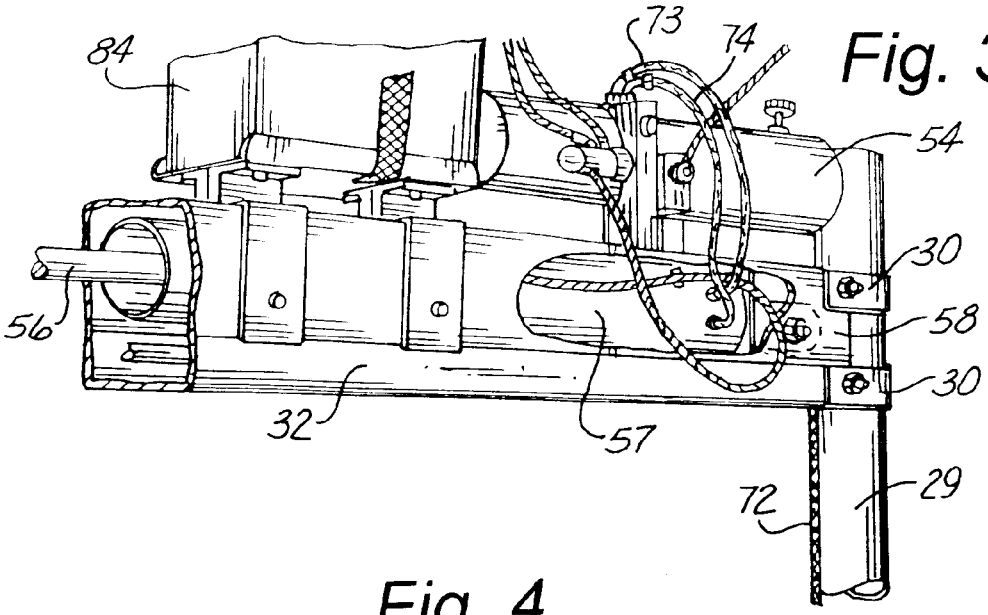
Fig. 3
Fig. 4
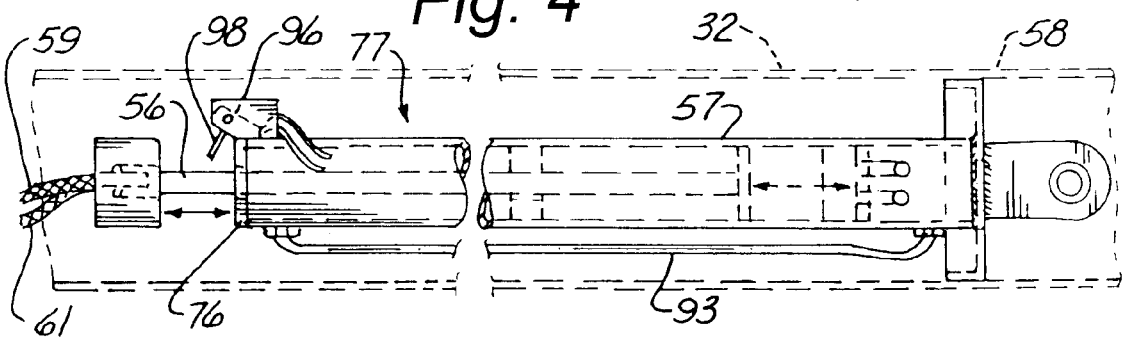
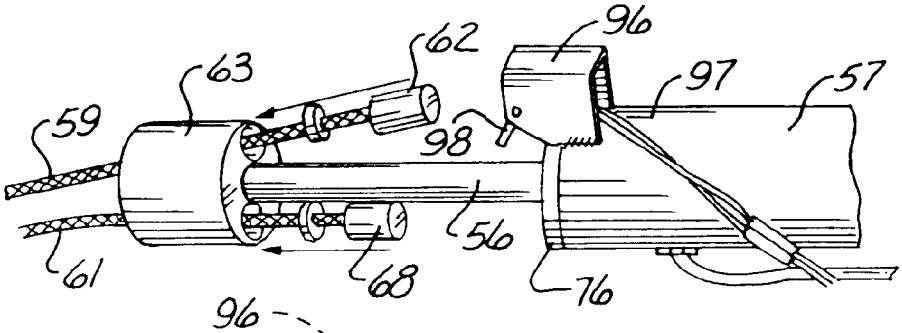
Fig. 5
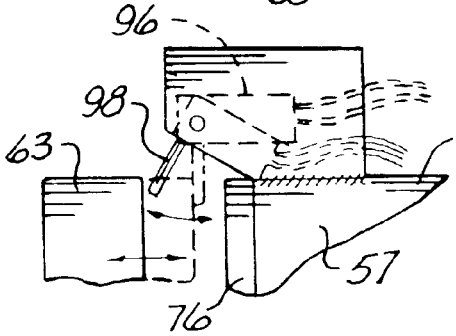
Fig. 6

HYDRAULIC BOAT HOIST

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates generally to boat hoists, and more particularly to a boat hoist employing hydraulic power for applying lift to a vertically movable platform in combination with a mechanical level lift suspension system.

2. Description of the Related Art

Conventional boat hoists employing pulleys and cables arranged in connection with a stationary, but movable, frame and a boat supporting platform for vertically lifting and lowering the platform on the frame utilize, normally, a mechanical hand operated winch connected within the cable and pulley suspension system for controlling the platform positioning. This arrangement is depicted and illustrated in an earlier patent of mine, U.S. Pat. No. Re. 32,118 issued Apr. 22, 1986, which reference is incorporated herein.

To those operationally familiar with this type of boat hoist, regardless of the effort of ease, quiet, and trouble free operation of same, improvements can be made. It is to that goal that this invention is directed.

BRIEF SUMMARY OF THE INVENTION

The present invention includes a lightweight aluminum boat hoist employing a stabilized lift suspension system similar to that described in U.S. Pat. No. 32,118, but with a hydraulic piston and cylinder unit contained primarily within one of the frame top rails for cable and pulley connection to one side of the lifting platform instead of the hand-operated lift-wheel arrangement of the U.S. Pat. No. Re. 32,118, all with attendant advantages described hereinafter.

An object, therefore, of the present invention is to provide an improved boat hoist.

Another object is to provide a boat hoist with a platform suspension and lifting system which is fast, quiet and easy to operate.

Yet another object of this invention is the provision of a boat hoist utilizing a hydraulic piston and cylinder system capable not only of raising and lowering the boat supporting platform, but of hydraulically locking the system such as to prevent accidental lowering of the platform from a raised position.

Still another object of this invention is the provision of hydraulic means for operating the boat lift while retaining an attractive, aesthetic appearance of the boat hoist.

Another object is the provision of remote control means associated with the hoist for controlling the hydraulic means, the remote control easily and readily accessible to a person either within the boat using the boat hoist, or on an adjacent dock.

Yet another object of this invention is to provide an improved platform side for easier personal access into and out of the boat positioned within the boat hoist, and adjacent a dock.

Other objects, advantages, and novel features of the present invention will become apparent from the following detailed description of the invention when considered in conjunction with the accompanying drawings.

BRIEF DESCRIPTION OF THE SEVERAL VIEWS OF THE DRAWINGS

FIG. 3 is a view similar to FIG. 2, but with portions of the top side rail broken away to disclose part of the piston and cylinder structure contained therein;

FIG. 4 is a side elevational view of the hydraulic piston and cylinder structure within the side rail, the latter shown in dashed lines;

FIG. 5 is an enlarged detail view of portions of the piston and cylinder shown in conjunction with elements of the cable system, and a mechanically operated solenoid switch for locking the cylinder into a safe mode;

FIG. 6 is an enlarged side elevational view of the safety switch, certain elements shown in alternative positions by the use of dashed lines;

DETAILED DESCRIPTION OF THE INVENTION

Figure 1:
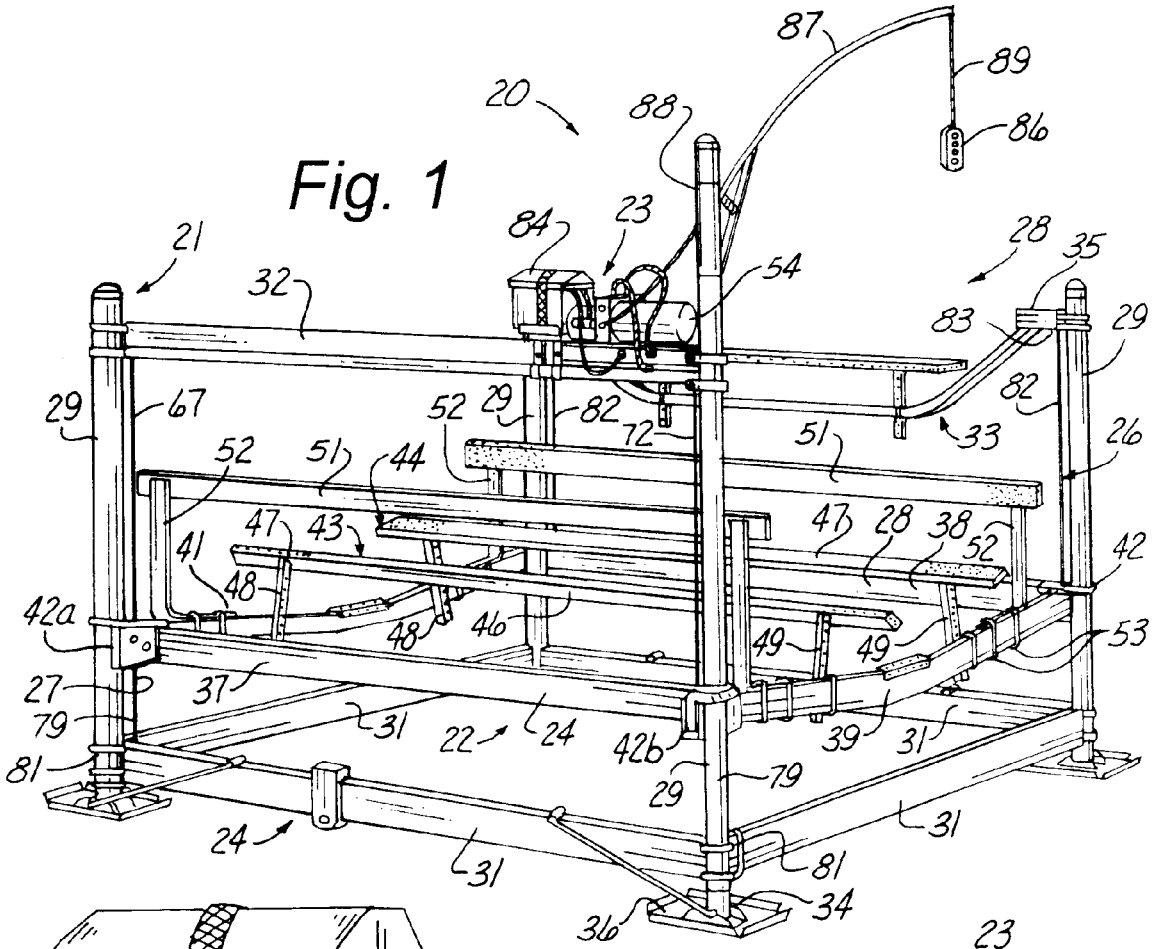
FIG. 1 is a perspective view of the boat hoist of this invention.

Referring now to the drawings, wherein like reference numerals designate identical or corresponding parts throughout the several views, FIG. 1 illustrates the structure of the boat hoist (20) of this invention, which hoist (20) includes generally a rectangular lifting frame (21) normally supported on a lake bed or like body of water, a horizontally disposed platform (22) slidably attached to the frame (21) and movable in a vertical direction between a lowered position on the frame (21) and a raised position thereon, a hydraulically operated assembly (23) (see FIG. 7) interconnected between the frame (21) and the platform (22) for exerting an upwardly directed force on the movable platform (22) on one (24) side thereof, and a pair of pulley and cable units (26), (27) interconnected between the frame (21) and the platform (22) for transmitting the upwardly directed force from the one side (24) of the platform (22) to the opposite side (28) thereof, wherein the upwardly directed force is evenly distributed between the opposite sides (24), (28) so as to raise the platform (22) in a level manner.

Figure 7:
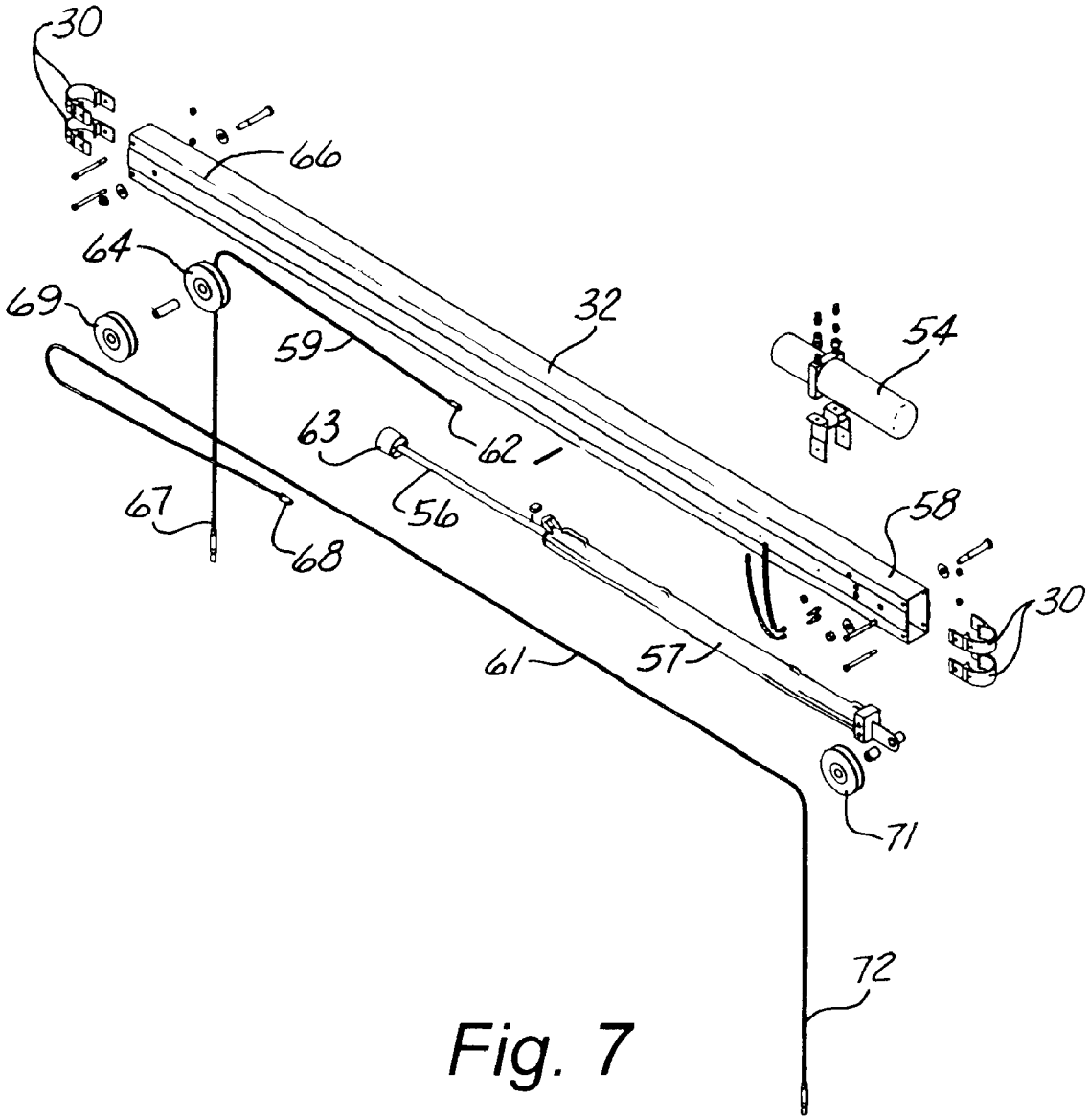
FIG. 7 is a perspective, exploded view of the hydraulic and cable system associated therewith, along with the side rail of the frame for containing the system shown.

More specifically, the frame (21) consists of four vertically disposed posts (29) all of which are interconnected by a quartet of bottom rails (31) thus forming a rectangular structure. A pair of top rails (32), (33) are mounted and supported between posts (29), one on each side of the frame (21) so as to provide an unobstructed passageway between the top rails (32), (33) for a boat (not shown) to float between the rails (32), (33) and be supported on the movable platform (22). As viewed in plan, the rails (32), (33) are parallel each other. Although other methods of mounting may be used, FIG. 7 shows that a pair of U-shaped clamps (30) and associated hardware are used at each end of the top rail (32) for adjustably securing it to the posts (29). The opposite rail (33) (FIG. 8) is shown in three pieces, a pair of connecting braces (35) at each end, with a drop side weldment (40) forming a central portion, the braces (35) also adjustably secured to the posts (29) by U-clamps (35*a*). In side elevation, the weldment (40) is lower than the rail (32) for use by personnel. Each post (29) has a telescoping leg (34) inserted therein at its base end, with a base pad (36) pivotally connected to each leg (34), whereby the frame (21) may be mounted on uneven lake beds while retaining the frame (21) upright, and particularly with the movable platform (22) supported in a normally horizontally disposed position.

The movable platform (22) includes a pair of rail beams (37), (38) each mounted on each side (24), (28) of the frame (21) between a pair of posts (29), and includes further a pair of cradle beams (39), (41) mounted at the fore and aft ends of the hoist (20), each connected between a pair of posts (29). In this manner, the quartet of beams (37)–(41) form a rectangular platform (22). A corner guide ring (42) interconnects each adjacent beam (37)–(41) end and slidingly embraces each post (29), thus allowing the platform (22) to move between lowered and raised positions on the frame (21).

To support a boat on the platform (22), a pair of elongated bunk units (43), (44) are provided, each comprising an elongated bunk support (46) for supporting a padded bunk (47), each bunk support (46) mounted for horizontal and vertical adjustment on the cradle beams (39), (41) by a pair of bunk brackets (48), (49). An elongated load guide (51) may be mounted to an outer side of each bunk unit (43), (44) by adjustable arms (52) secured also to the cradle beams (39), (41) by U-bolts (53) as illustrated.

Figure 2:
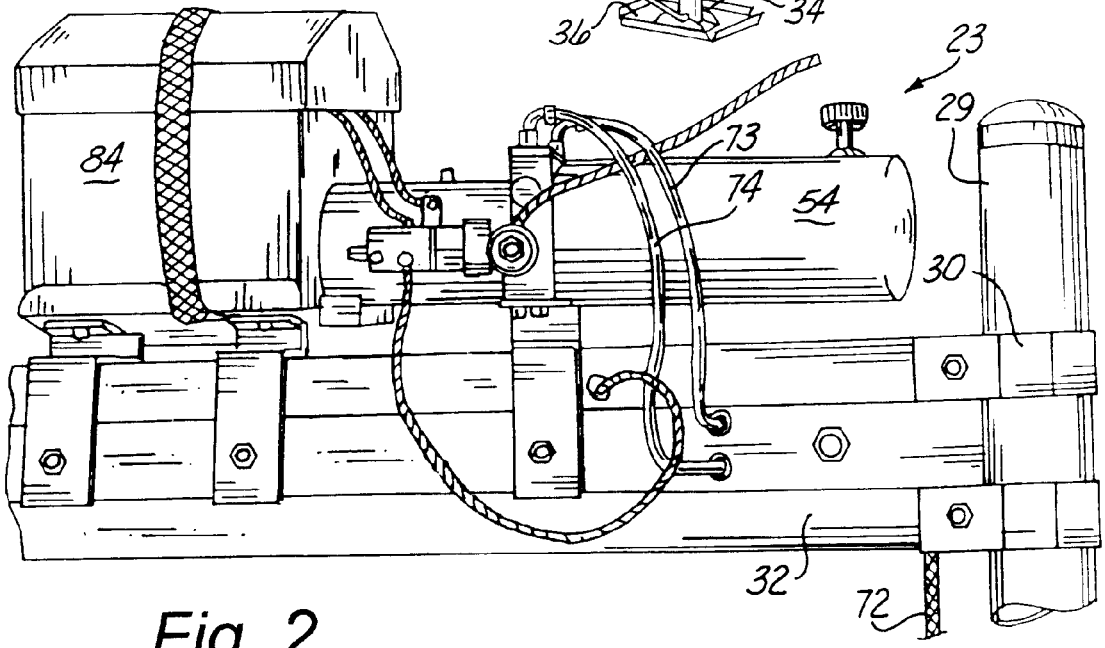
FIG. 2 is an enlarged view of the hydraulic pump and DC battery pack mounting arrangement.

The hydraulically operated assembly (23) includes a hydraulic pump unit (54) mounted on the outboard side top rail (32) (FIGS. 1–3) which operates a piston (56) and cylinder (57) unit mounted within the rail (32) (FIGS. 3 and 4) at one end (58) thereof. As most clearly see in FIGS. 5–7, the lifting system is comprised of a pair of cables (59), (61). One end (62) of cable (59) is connected to an exposed block end (63) of the piston (56), is trained over a pulley (64) rotatably mounted in an opposite end (66) of the rail (32), with the opposite end (67) of the cable (59) connected to the corner guide ring (42*a*) (FIG. 1) directly below the pulley (64).

The other cable (61) has an end (68) also connected to the piston block end (63), then trained under a pulley (69) rotatably mounted alongside pulley (64) over and back through the rail (32) to another pulley (71) rotatably mounted at end (58) of the rail (32), with the opposite end (72) of the second cable (61) connected to a corner guide ring (42*b*) directly below the pulley (71). It will be noted that the guide rings (42*a*), (42*b*) are at opposite ends of the outboard side rail beam (37) of the platform (22). By this arrangement, operation of the hydraulic pump unit (54) through hydraulic lines (73), (74) to the cylinder (57) to retract the piston (56) from an extended position (FIG. 7) wherein the platform (22) is lowered to a retracted position wherein the piston block (63) approaches the inner end (76) (FIG. 4) of the cylinder (57), this operation effects a lifting of the platform (22) at both corner guide rings (42*a*) and (42*b*). It is to be noted that although a certain lifting advantage is illustrated, any of a number of different systems could be employed that would exert an upwardly directed force on the one or more points on the platform (22).

To ensure that the lifting of the platform (22) by the hydraulic action of the piston and cylinder unit (77) is applied to the platform in a level manner, the suspension system utilizes the teaching of my U.S. Pat. No. Re. 32,118 issued Apr. 22, 1986 and incorporated herein, wherein a pair of identical stabilizing systems (26), (27) (FIG. 1) are shown—one operating in conjunction with the force exerted at guide ring (42*a*), and the other operating in conjunction with the force exerted at guide ring (42*b*). Each system (26), (27) acts to transmit the upwardly directed force to a point on the platform (22) remote from the guide ring points (42*a*), (42*b*), such that the force is evenly distributed between all points and the tendency of the platform (22) to twist is minimized.

As each system (26), (27) is identical, only one will be described. The system (26) includes a flexible cable having a predetermined length and one end (79) (FIG. 1) attached to a point (81) on the frame (21) adjacent a bottom of a post (29) below corner guide ring (42*b*), and the opposite end (82) attached at a point (83) of the frame (21) adjacent a brace (35). Point (81) is located below the lowered position of the platform (22), and point (83) is above the raised position of the platform (22). Cable end (79) extends upwardly and is trained over a pulley (not shown) rotatably mounted thereabove in the cradle beam (39), an intermediate portion of the cable (not shown) extends through the beam (39) to another pulley (not shown) rotatably mounted in the right end—as viewed, of the beam (39), being trained thereunder, with the cable end (82) extended upwardly to point (83).

Figure 9:
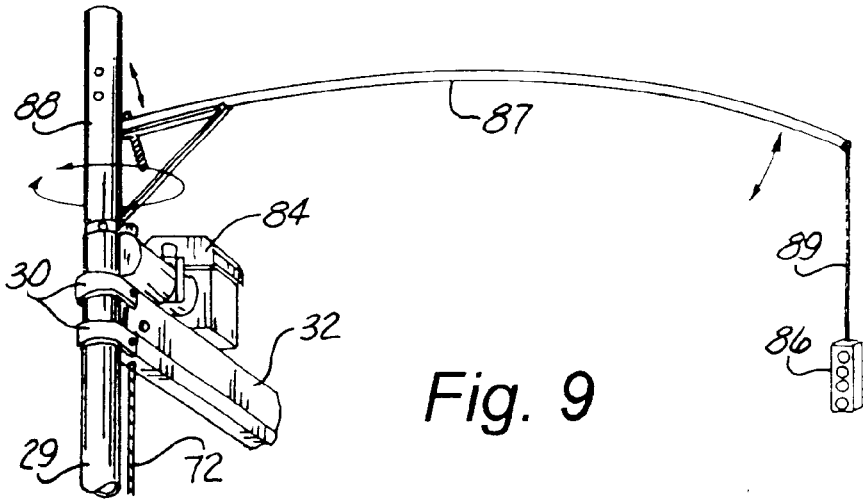
FIG. 9 is a detail, perspective view of a control arm mounting on the frame for swingably holding a hand operated remote control for the hydraulic system.
Figure 10:
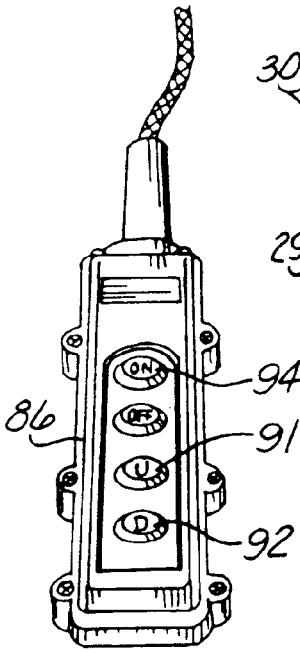
FIG. 10 is a further enlarged detail view of the remote control.

The hydraulic pump unit (54) may be operated by a pre-wired system with two types of conventional hook-ups so it can be powered by an auxiliary battery (84), boat battery or from an A.C. power source normally on shore. A hand-held controller (86) (FIG. 10), may be utilized, with ON, OFF, UP and DOWN control push buttons. With the use of a control arm tube (87) (FIG. 9) rotatably mounted by a pivot unit (88) on a post (29) adjacent the pump unit (54), and wherein the controller (86) may be suspended from the tube (87) by a controller cable (89), the hand-held controller's push button operation allows raising or lowering the platform (22) from a dock (not shown) adjacent the hoist (20) or from a seat in a boat entering or leaving the hoist (20).

In operation, to raise the platform (22), the UP button (91) is pushed, whereupon the piston and cylinder unit (77) is operated to retract the piston (56) within the cylinder (57). To lower the platform (22), the DOWN button (92) is pushed, whereupon the double-acting cylinder (57) reverses the hydraulics via a bypass conduit (93) and conventional internal valving such that the piston (56) is extended to let down—in effect, the cables (59), (61), with the stabilizing cables (79), (81) acting accordingly.

The ON button (94) being addressed places the hydraulic system in an automatic mode—a third position, other than OFF, such that the platform (22) will retain a raised position. This arrangement is controlled by the provision of a microswitch (96) mounted on an outer end (97) (FIGS. 4 and 6) of the cylinder (57), and electrically connected to a solenoid (not shown) mounted on the pump unit (54). With the ON button (94) pushed, the piston (56) continues to retract thus raising the platform (22) until the piston block (63) engages the switch flap (98) thereby turning off the pump unit (54). Should the platform (22) start to lower without operation of the controller (86), upon the piston block (63) moving away from the switch (96) and disengaging from the switch flap (98), the switch (96) acts to actuate the hydraulic pump unit (54) back on, thus re-raising the platform (22) by retracting the piston (56). Thus, the switch (96) operates to maintain the platform (22) in a raised position at all times.

Figure 11:
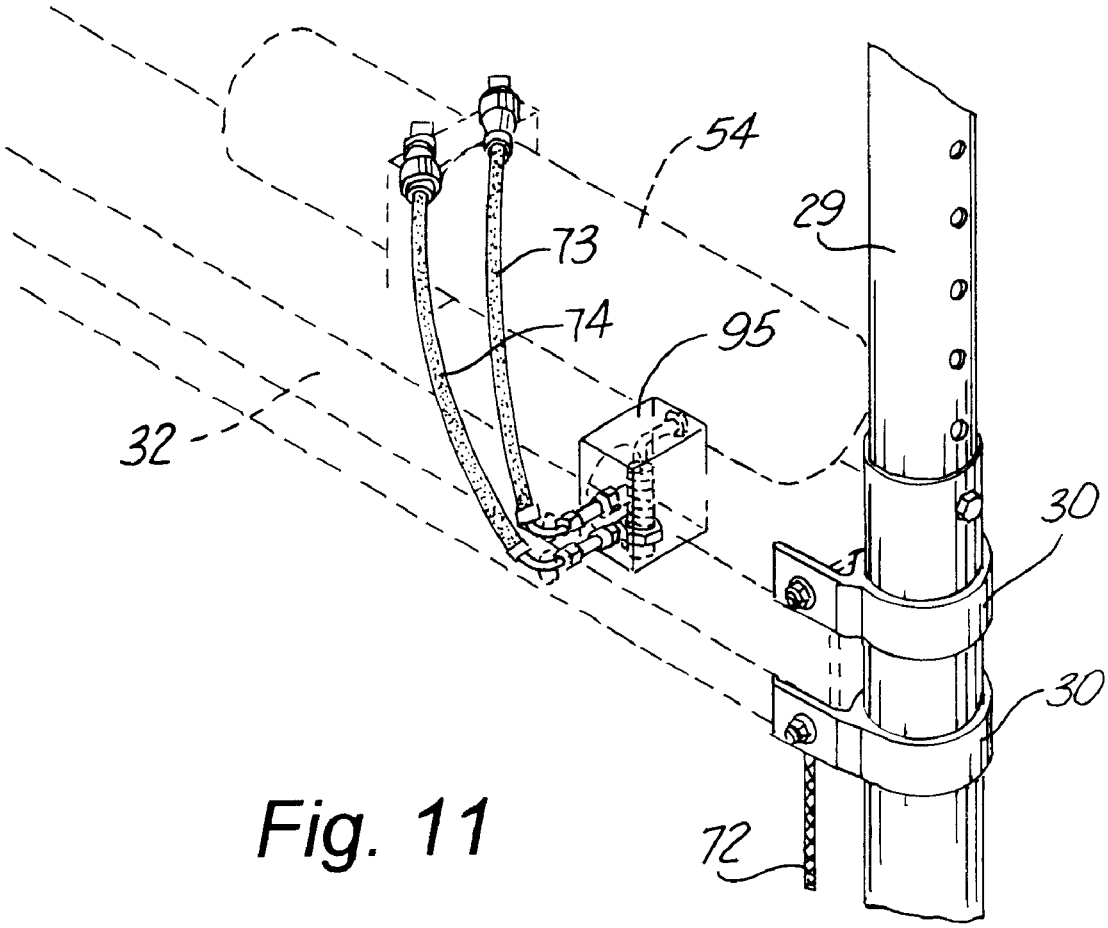
FIG. 11 is an enlarged, detail view, in perspective, of a valve arrangement for hydraulically locking the cylinder and piston in a certain position to prevent accidental lowering of the movable platform.

An additional safety feature may be incorporated into the hydraulic system to ensure against an accidental lowering of the platform (22) due to a loss of hydraulic fluid, such as a line rupture within the hydraulic pump unit (54) or of a hydraulic line. A valve (95) (FIG. 11) may be inserted between the hydraulic lines (73), (74) and the cylinder (57) to maintain pressure on the back side of the piston (56) at all times.

In normal conditions, the valve (95), sold by Bobalee Hydraulics under part number "CCA LHNSUN VALVE, is maintained in an open position to permit normal flow of fluid in the lines (73), (74), but should pressure be reduced, the valve will immediately close to maintain pressure on the back side of the piston (56) within the cylinder (57) so as to prevent the weight of the platform (22) from extending the piston (56) outwardly of the cylinder (57), thus lowering the platform (22), and possibly a boat thereon, into the water such that the boat could float uncontrolled.

Figure 8:
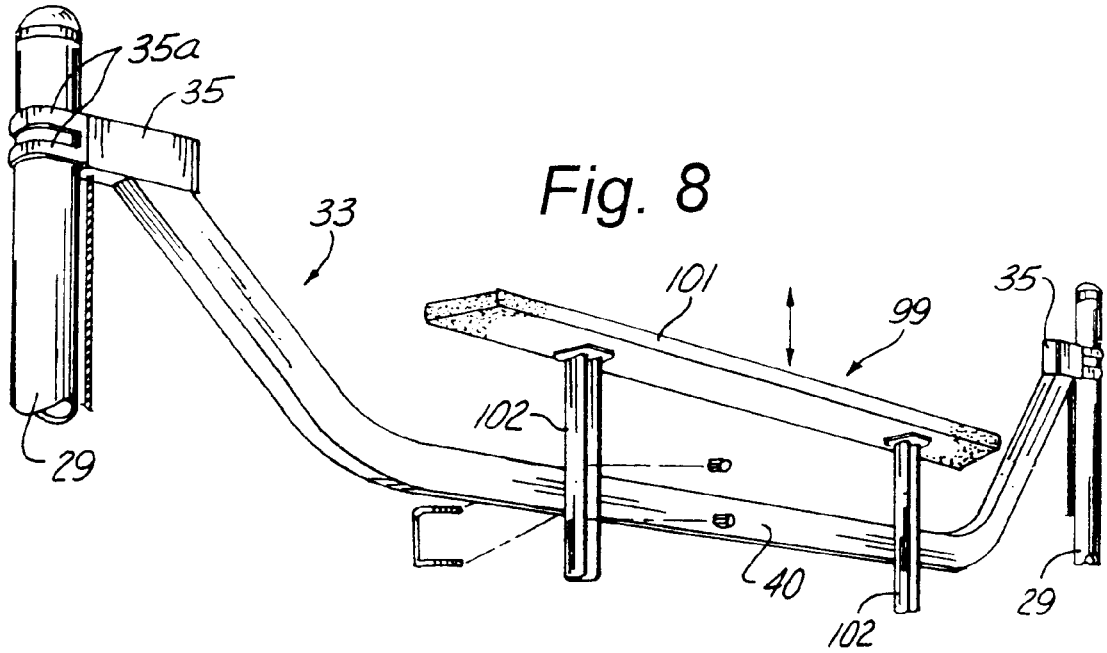
FIG. 8 is an enlarged, detail view, in perspective, of an inboard top side rail of the platform.

Referring now to FIGS. 1 and 8, personnel step unit (99) is provided for aiding access to and from the boat (not shown) supported on the platform (22). The unit (99) consists of an elongated step bunk (101) mounted by a pair of brackets (102) to the drop side weldment (40). It will be noted that the step unit (99) is mounted on the inboard side (24) of the frame (21), with the hydraulic pump unit (54) and piston and cylinder unit (77) mounted on the outboard side (28). Thus, a person may easily step into or out of the boat from or to an adjacent dock by stepping onto the step bunk (101); or should the step bunk (101) not be used, the drop side weldment central portion (40) also may provide step support of personnel for access to and from a boat supported on the platform (22).

I claim:

1. A hydraulically operated boat hoist comprising:

a rectangular lifting frame having four corners;

a horizontally disposed platform attached to said frame, said platform being movable in a vertical direction between a lowered position and a raised position;

first means for exerting an upwardly directed force at a first point on said movable platform;

second means separate from said first means for transmitting said upwardly directed force to a second point on said movable platform remote from said first point, wherein said upwardly directed force is evenly distributed between said first point and said second remote point, to raise the platform in a level manner;

said first means including hydraulic means operable in a first position to raise said platform, operable in a second position to lower said platform, and operable in a third position to maintain said platform in a raised position;

wherein said hydraulic means includes a piston and cylinder unit, with said piston connected at an exposed end to a pair of flexible cables having free ends each of which is connected to a said first point; and wherein said hydraulic means including further a switch unit mounted on said cylinder, said switch unit operable upon engagement with said piston to place said hydraulic means in said third position.

2. The boat hoist of claim 1, including means for remotely controlling said hydraulic means, and including further means rotatably mounted on said lifting frame for suspending said remote control means at one or more positions above said platform, whereby said remote control means is accessible to hand operation from a person within a boat utilizing said platform.

3. The boat hoist of claim 1, including hydraulic valve means associated with said hydraulic means for locking said cylinder and piston in a predetermined position preventing operation of said hydraulic means to lower said platform.

* * * * *